US005292104A

United States Patent [19]

Ushitora et al.

[11] Patent Number: 5,292,104

[45] Date of Patent: Mar. 8, 1994

[54] VACUUM INTERFACE VALVE

[75] Inventors: Akihiro Ushitora; Yoshiharu Takahashi, both of Tokyo, Japan

[73] Assignee: Ebara Corporation, Tokyo, Japan

[21] Appl. No.: 980,924

[22] Filed: Nov. 24, 1992

[30] Foreign Application Priority Data

Nov. 27, 1991 [JP] Japan ..... 3-312264

[51] Int. Cl.[5] ..... F16K 31/145

[52] U.S. Cl. ..... 251/61.2

[58] Field of Search ..... 251/366, 61.5, 61.2; 137/907

[56] References Cited

U.S. PATENT DOCUMENTS

| | | | |
|---|---|---|---|
| 642,154 | 1/1900 | Perry | 137/907 |
| 2,685,426 | 8/1954 | MacGregor | 251/366 |
| 4,171,853 | 10/1979 | Cleaver et al. . | |
| 5,074,718 | 12/1991 | Ushitora et al. . | |
| 5,082,238 | 1/1992 | Grooms et al. | 137/907 |
| 5,083,885 | 1/1992 | Ushitora et al. . | |
| 5,100,266 | 3/1992 | Ushitora et al. . | |
| 5,114,280 | 5/1992 | Ushitora et al. . | |

FOREIGN PATENT DOCUMENTS

| | | | |
|---|---|---|---|
| 0445462 | 9/1991 | European Pat. Off. . | |
| 550090 | 8/1932 | Fed. Rep. of Germany | 251/366 |
| 1459592 | 4/1969 | Fed. Rep. of Germany . | |
| 11156 | 10/1907 | France . | |
| 402491 | 12/1909 | France . | |
| 477567 | 10/1915 | France . | |
| 2149534 | 6/1985 | United Kingdom . | |

*Primary Examiner*—A. Michael Chambers

*Attorney, Agent, or Firm*—Wenderoth, Lind & Ponack

[57] ABSTRACT

A vacuum interface valve is used in a vacuum sewerage system in which sewage is transported under the influence of vacuum to a wastewater treatment station or a public main sewer. The vacuum interface valve includes a casing having an inlet, an outlet and a valve seat, a valve member which is linearly movable between a position engageable with the valve seat and a position away from the valve seat, an element for urging the valve member into engagement with the valve seat, and a vacuum device for lifting the valve member under the action of a vacuum to cause the valve member to disengage from the valve seat. The inner wall of the casing is bulged outwardly from the vicinity of the valve seat in a direction substantially perpendicular to an axis of the valve member, and a space is defined in the vicinity of the valve seat in the casing so that foreign matters are not caught between the inner wall of the casing and the valve member.

7 Claims, 7 Drawing Sheets

VACUUM INTERFACE VALVE

BACKGROUND OF THE INVENTION

1. Field of the Invention

The present invention relates to a vacuum interface valve, and more particularly to a vacuum interface valve for use in a vacuum sewerage system in which sewage drained from houses is transported under the influence of a vacuum to a wastewater treatment station or a public main sewer.

2. Description of the Prior Art

Recently, a vacuum sewerage system is becoming recognized as an economical alternative to a conventional gravity sewerage system including a network of underground pipes which is constructed at a relatively high cost. The vacuum sewerage system comprises sumps with a vacuum interface valve, vacuum sewers and a vacuum collection station.

In the vacuum sewerage system, downhill flow of sewage drained from houses is collected in the sump with the vacuum interface valve. When a control device detects a predetermined liquid level of the sump, the vacuum interface valve is opened to feed sewage in the sump into the vacuum sewer. After finishing the feed of sewage in the sump, the vacuum interface valve continues to be opened for a certain period of time, during which atmospheric air is sucked into the vacuum sewer. The sewage is mixed with the expanded air in the vacuum sewer to form a mixed flow and is conveyed to the vacuum collection station. When the sewage collected in a collection tank of the vacuum collection station reaches a certain liquid level, the sewage is fed to the wastewater treatment station or the public main sewer by discharge pumps.

Next, a conventional vacuum interface valve in the vacuum sewerage system will be described with reference to FIGS. 6 and 7. The conventional vacuum interface valve V comprises a casing 21 having a substantially Y-shaped body, a valve member 22 which is moved up and down in an oblique direction with respect to an axis of the vacuum sewer, and a valve rod 23 for supporting the valve member 22. The casing 21 has an inlet 21*i* and an outlet 21*o* which extend in a horizontal direction. On the upper portion of the casing 21 there is provided a housing 25 in which a piston 26 is provided so as to perform a reciprocating motion. The valve rod 23 is formed, at the upper portion thereof, with a screw 23*a*. The piston 26 is fixed to the valve rod 23 by being held between a plate 27 and a nut 28 engaging the screw 23*a*.

A diaphragm 29 is provided between the piston 26 and the housing 25 to define two chambers, that is, a vacuum chamber 25*a* and an atmospheric chamber 25*b*. A compressive coil spring 30 is provided between the upper wall of the housing 25 and the piston 26 to urge the piston 26 obliquely downwardly.

According to the vacuum interface valve V thus constructed, in closing the valve, when the valve rod 23 is extended downwardly by the urging force of the spring 30, the valve member 22 engages a valve seat 21*s* formed in the casing 21 and prevents sewage from flowing from the inlet 21*i* to the outlet 21*o*.

In contrast, in opening the valve, when the vacuum chamber 25*a* is placed in communication with a vacuum source and the valve rod 23 is retracted by a pressure difference between the vacuum chamber 25*a* and the atmospheric chamber 25*b*, the valve member 22 is moved away from the valve seat 21*s* and sewage can flow from the inlet 21*i* to the outlet 21*o*.

However, in the conventional vacuum interface valve V, since a gap g between the valve member 22 and the inner wall of the casing 21 is small, foreign matters F such as gravel are caught between the inner wall of the casing 21 and the valve member 22 as shown in FIG. 7 and the valve member 22 is stuck at a partially opened position. Since the gap g is constant along a stroke of the valve member 22 to guide the valve member 22, there is a high possibility that the foreign matters F are caught everywhere during the actuation of the valve member 22.

Further, when the valve member 22 is stuck at the partially opened position by the existence of the foreign matters F, vacuum in the total sewerage system is lost, resulting in a malfunction of the system.

SUMMARY OF THE INVENTION

It is an object of the present invention to provide a vacuum interface valve in which a wide space can be defined in the vicinity of a valve seat so that foreign matters such as gravel are not caught between the inner wall of the casing and the valve member.

According to the present invention, there is provided a vacuum interface valve for use in a vacuum sewerage system comprising: a casing having an inlet, an outlet and a valve seat; a valve member provided in the casing and being linearly movable between a position engageable with the valve seat and a position away from the valve seat; means for urging the valve member into engagement with the valve seat; and means for lifting the valve member under the action of a vacuum to cause the valve member to disengage from the valve seat; wherein the casing has an inner wall which bulges outwardly in the vicinity of the valve seat in a direction substantially perpendicular to an axis of said valve member so that foreign matter will not be caught between the inner wall of the casing and the valve member.

With the above structure, since the inner wall of the casing bulges outwardly in the vicinity of the valve seat in a direction substantially perpendicular to an axis of the valve member, a wide space is defined in the vicinity of the valve seat in the casing. Therefore, foreign matters will not be caught between the inner wall of the casing and the valve member, the valve member can be prevented from being stuck at a partially opened position by the existence of the foreign matters and the vacuum sewerage system can be always operated in a normal condition. The above and other objects, features and advantages of the present invention will become more apparent from the following description when taken in conjunction with the accompanying drawings in which a preferred embodiment of the present invention is shown by way of an illustrative example.

DETAILED DESCRIPTION OF THE PREFERRED EMBODIMENTS

A vacuum interface valve of the present invention will be described below with reference to FIGS. 1 through 3.

Figure 1:
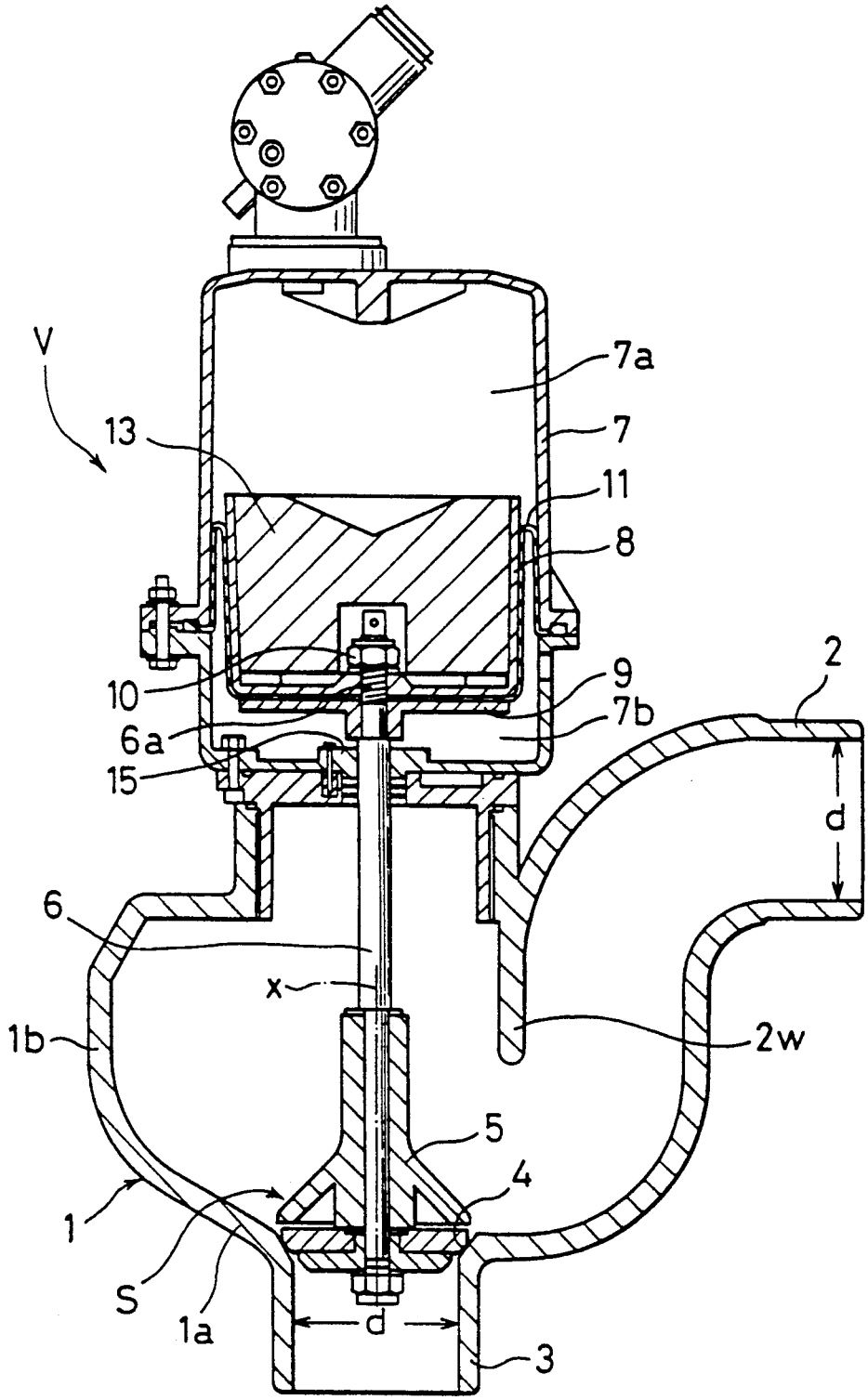
FIG. 1 is a cross-sectional view of a first embodiment of a vacuum interface valve according to the present invention.
Figure 2:
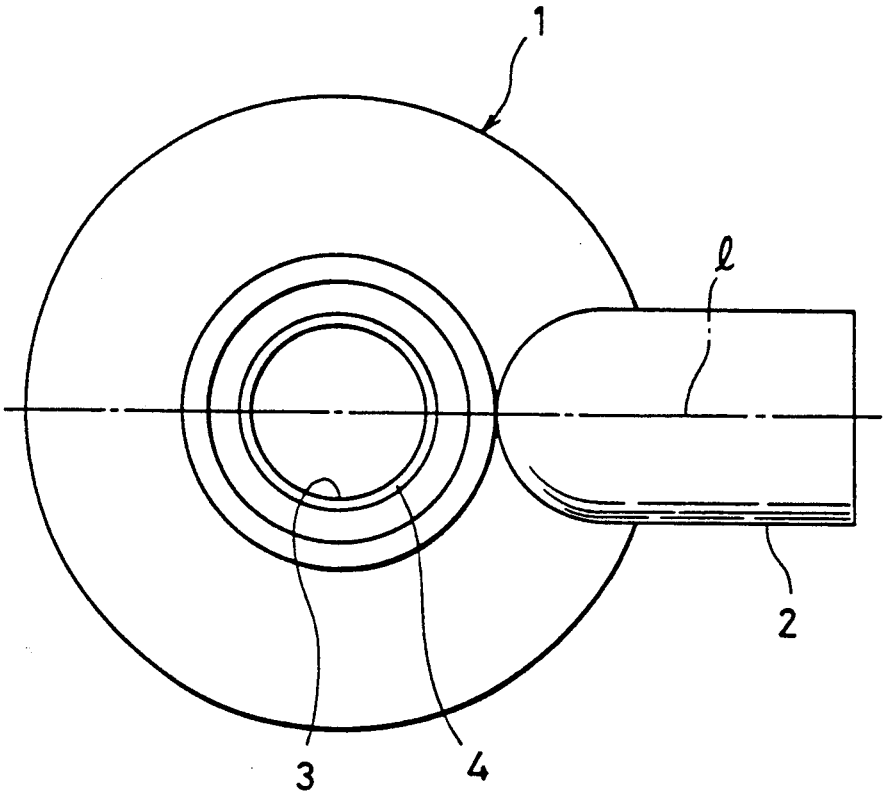
FIG. 2 is a plan view of a casing of the vacuum interface valve according to the present invention.
Figure 3:
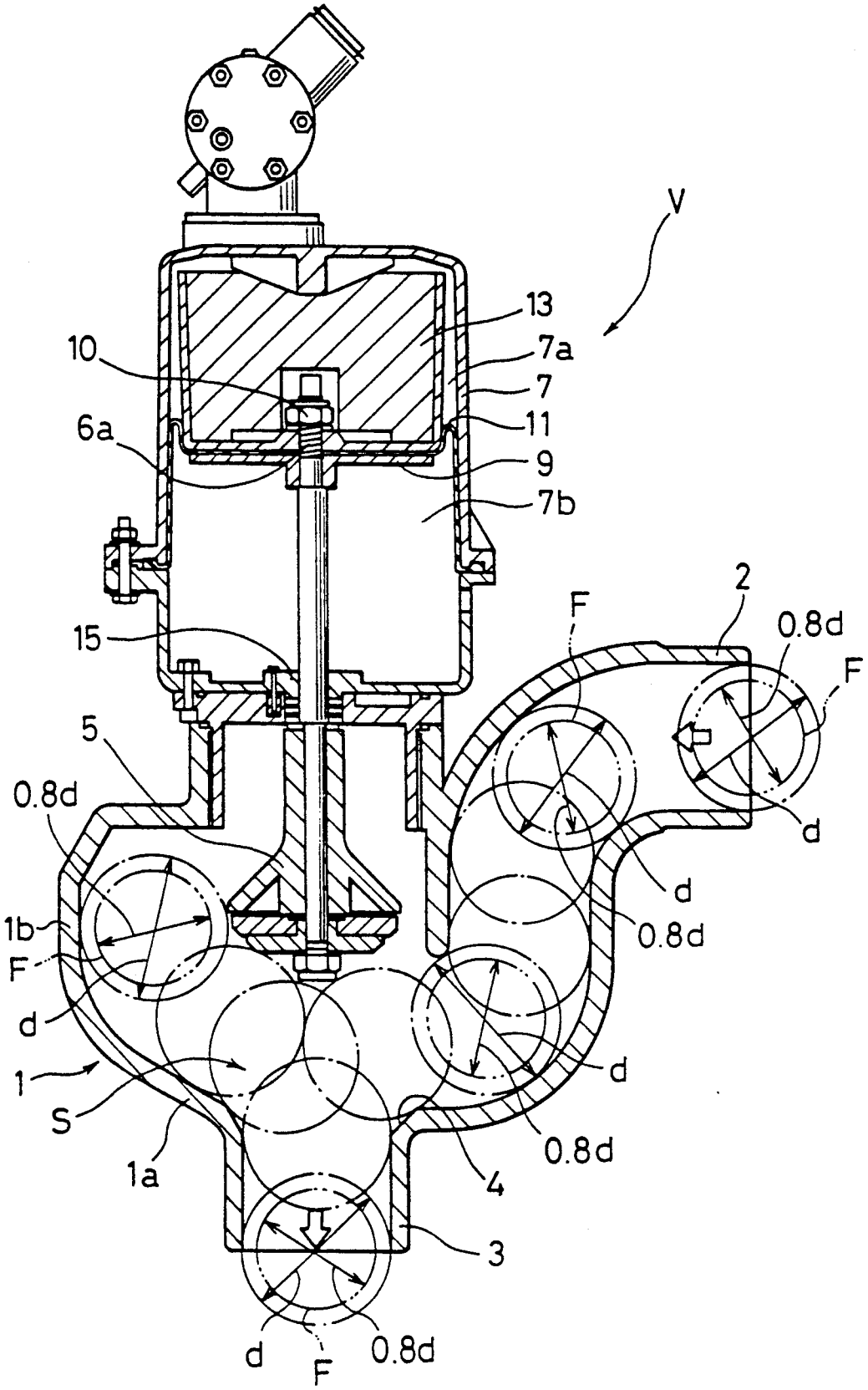
FIG. 3 is a cross-sectional view of the vacuum interface valve showing the manner in which the valve operates.

As shown in FIGS. 1 and 2, a vacuum interface valve V comprises a casing 1, a valve member 5 which is moved up and down in a vertical direction, and a valve rod 6 for supporting the valve member 5. The casing 1 has a cylindrical receptacle-like shape comprising a bottom wall 1*a* and a cylindrical side wall 1*b* extending from the bottom wall 1*a* upwardly. The casing 1 is provided with an inlet 2 at the upper portion thereof and an outlet 3 at the bottom portion thereof. The casing 1 is formed with a valve seat 4 at the upper and inner peripheral portion of the outlet 3. The inlet 2 and the outlet 3 have the same inside diameter d. As shown in FIGS. 1 and 2, the inlet 2 extends vertically from a position slightly spaced from the central portion of the casing 1 and extends radially outwardly along central line 1 (see FIG. 2) after changing direction at an angle of approximately 90 degrees, and finally is open radially outwardly. In other words, the inlet 2 has an inside wall portion 2*w* which extends parallel to an axis x of the valve member 5 inside the casing 1. The outlet 3 extends vertically downwardly from the central position of the bottom wall 1*a*.

Therefore, liquid flowing into the inlet 2 flows radially inwardly, then smoothly changes its course vertically downwardly, and finally is discharged downwardly from the outlet 3. A swirling stream is not formed in the casing 1, which would otherwise exert pressure or a force on the valve member 5.

The bottom wall 1*a* and the side wall 1*b* of the casing 1 bulge outwardly from the vicinity of the valve seat 4 in a direction substantially perpendicular to the axis x of the valve member 5 so that foreign matters such as gravel are not caught between the inner wall of the casing 1 and the valve member 5. The degree to which the bottom wall 1*a* and the side wall 1*b* bulge is such that a distance of at least 0.8 d exists between the inner wall of the casing 1 and the outer periphery of the valve member 5 when the valve is fully opened.

The valve member 5 has an approximately conical shape and is supported by the valve rod 6 extending vertically. On the upper portion of the casing 1 there is provided a housing 7 in which a piston 8 is provided so as to perform a reciprocating motion vertically. The valve rod 6 is formed, at the upper portion thereof, with a screw 6*a*. The piston 8 is fixed to the valve rod 6 by being held between a plate 9 and a nut 10 engaging the screw 6*a*.

A diaphragm 11 is provided between the piston 8 and the housing 7 to define two chambers, that is, a vacuum chamber 7*a* and an atmospheric chamber 7*b*. A weight 13 is provided in the housing 7 to urge the piston 8 downwardly. The valve member 5 engages the valve seat 4 under the force exerted by the weight 13 and prevents sewage from flowing from the inlet 2 to the outlet 3.

On the other hand, when the vacuum chamber 7*a* is placed in communication with a vacuum source and the valve rod 6 is retracted by a pressure difference between the vacuum chamber 7*a* and the atmospheric chamber 7*b* against gravity of the weight 13, the valve member 5 is moved upwardly and disengages the valve seat 4, and thus sewage can flow from the inlet 2 to the outlet 3. The force exerted by weight 13 is constant irrespective of opening degree of the valve, therefore, even if the degree of opening of the valve becomes large, there is no need for increasing the degree of vacuum.

Next, the operation of the vacuum interface valve of the present invention will be described below with reference to FIGS. 1 and 3.

The suction pipe of the vacuum interface valve V is arranged so that the gap between the lower end of the suction pipe and the bottom of the sump is smaller than the inner diameter d of the inlet 3 of the casing 1, in order that the suction pipe or the vacuum interface valve V is not blocked with a foreign matter having a diameter of d or more sucked therein. That is, the foreign matter having a diameter of d or more is checked, from entering the suction pipe by the gap between the suction pipe and the bottom of the sump. The gap is equal to 0.8 to 0.9 d; therefore, the maximum diameter of the foreign matter F flowing into the vacuum interface valve V is equal to 0.8 to 0.9 d.

In opening the valve, when the vacuum chamber 7*a* is placed in communication with a vacuum source and the valve rod 6 is retracted by a pressure difference between the vacuum chamber 7*a* and the atmospheric chamber 7*b* against the force exerted by of the weight 13, the valve member 5 is moved upwardly and disengages the valve seat 4, and thus sewage can flow from the inlet 2 to the outlet 3.

A wide space S is defined in the vicinity of the valve seat 4 in the casing 1 so that wide space can be defined with respect to the foreign matter F flowing into the casing 1 between the valve member 5 and the bottom wall 1*a* or the side wall 1*b*. That is, because the distance between the valve member 5 and the inner wall of the casing 1 is 0.8 d or more when the valve member 5 takes a fully opened position as shown in FIG. 3, an area necessary for allowing the foreign matter F to pass therethrough is ensured. Incidentally, in FIG. 3, the distance is equal to d as shown by alternate long and short dash lines. Thus, the foreign matter F (having a diameter of 0.8 d as shown by alternate long and two short dashes lines) is prevented from being caught between the valve member 5 and the casing 1, and the valve member 5 is prevented from being stuck open by the foreign matter F. Further, the foreign matter flowing toward the backside of the valve member 5 is easily discharged.

The inlet 2 is disposed at a level above the outlet 3 which is disposed at the lowermost portion of the casing 1, and the inlet 2 has the inside wall portion 2*w* which extends parallel to the axis x of the valve member 5 inside the casing 1. Thus, liquid flowing into the inlet 2 flows vertically downwardly parallel to the valve rod 6. Consequently, liquid flow does not impinge the valve member 5 directly, and a radial force is not applied to the valve member 5, so that wear of the bearing 15 or looseness of the valve member 5 can be prevented. Further, since liquid flowing into the inlet 2 reaches the outlet 3 directly without forming a swirling stream, the foreign matter F will not float inside the casing 1 and an elongated object does not remain in the casing 1. Even if the foreign matter F having a diameter of 0.8 d flows into the casing 1 as shown in FIG. 3, the flow passage defined from the inlet 2 to the outlet 3 in the casing 1 has a sectional area with a diameter of 0.8 d or more; therefore, the foreign matter F will not remain in the casing 1.

On the other hand, the weight 13 is utilized to provide an urging force for closing the valve. To be more specific, when vacuum applied to the vacuum chamber 7*a* is intercepted, the valve rod 6 is extended downwardly by the weight 13, and the valve member 5 engages the valve seat 4 and prevents sewage from flowing from the inlet 2 to the outlet 3.

Figure 6:
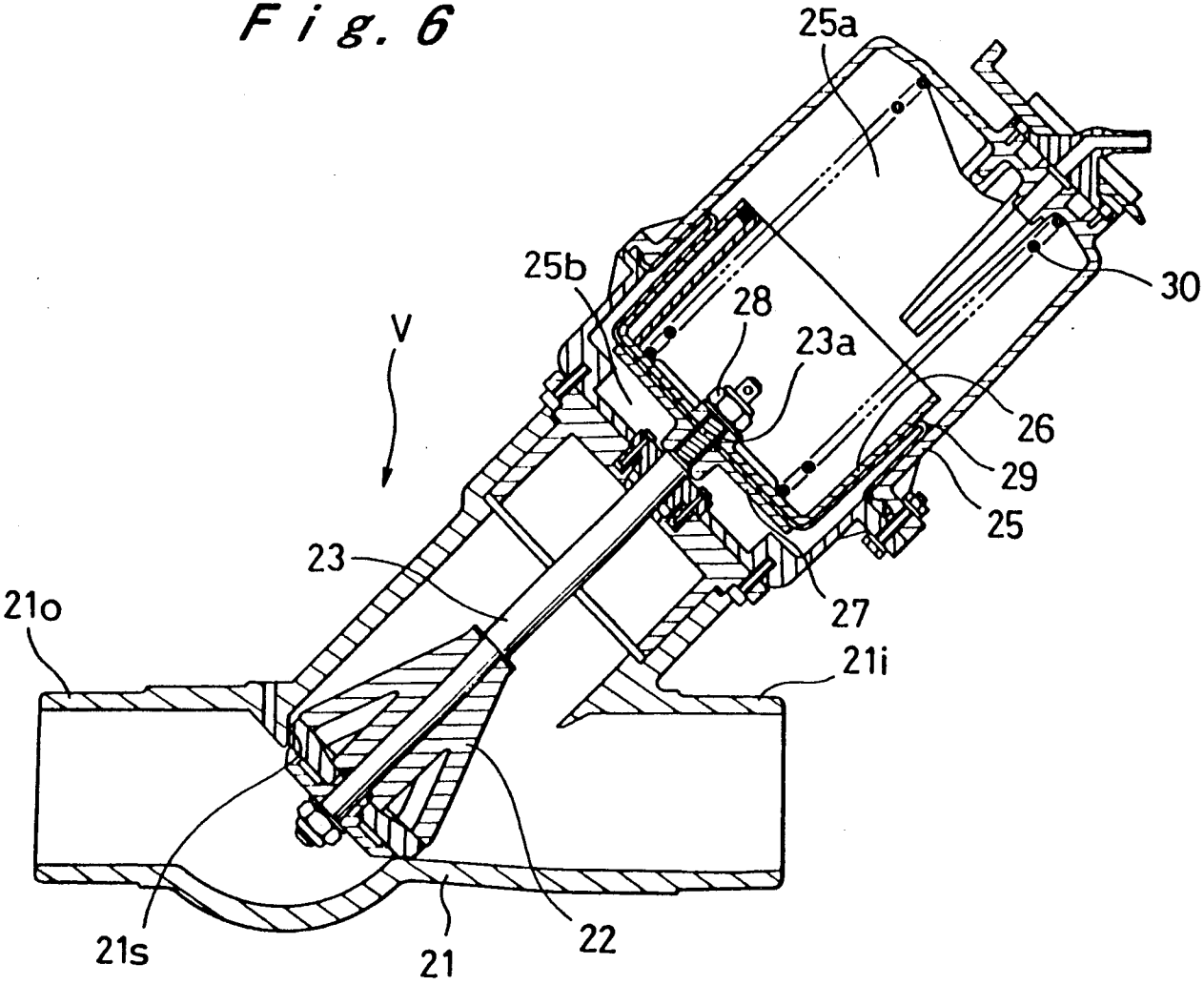
FIG. 6 is a cross-sectional view of a conventional vacuum interface valve.
Figure 7:
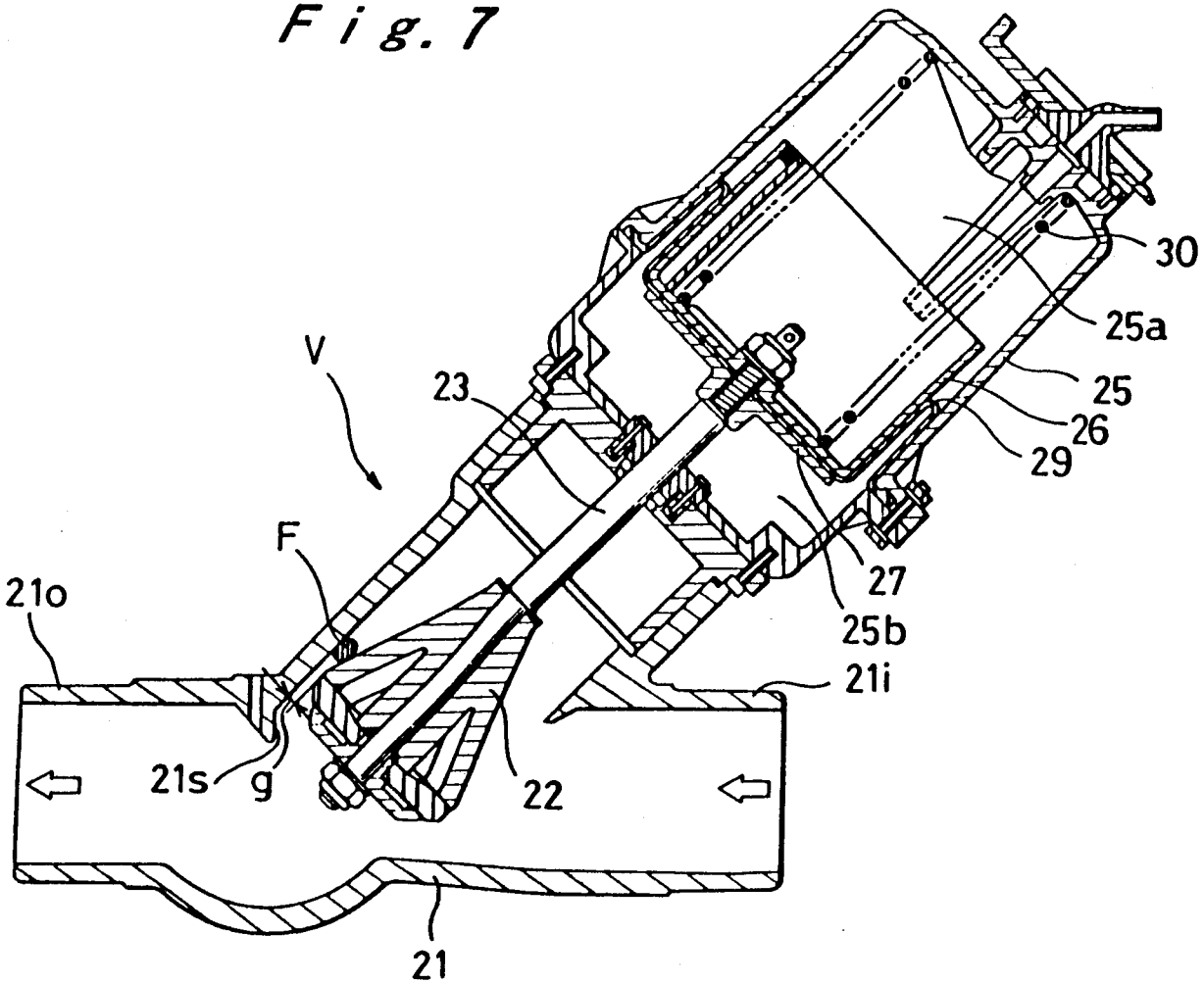
FIG. 7 is a cross-sectional view of the conventional vacuum interface valve showing the manner in which the valve operates.

According to the conventional vacuum interface valve in FIG. 6, in the case where the degree of vacuum applied to the vacuum chamber 25*a* is low, the valve member 22 does not reach a fully opened position due to the urging force of the spring 30 and is stuck at a partially opened position. Thus, the conventional vacuum interface valve is problematic in that the area of a flow passage for sewage in the casing becomes smaller, resulting in jamming. In contrast, in the present invention, because the weight 13 causes the valve member 5 to engage the valve seat 4, the force necessary for lifting the valve member 5 is constant, and it is easy to lift the valve member 5 up to a fully opened position. As a result, the valve member 5 does not remain at a partially opened position, and the area of the flow passage is not restricted.

Figure 4:
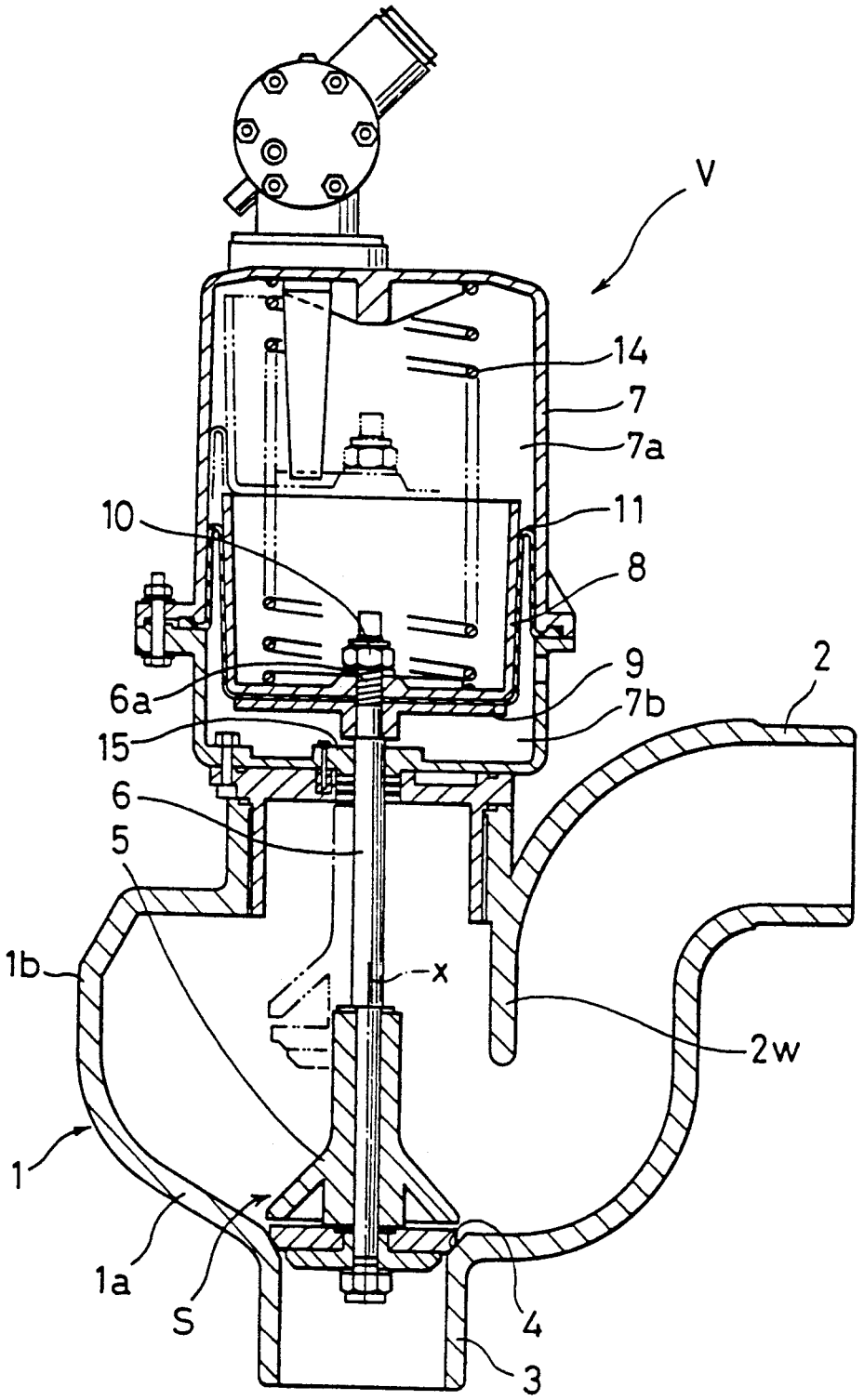
FIG. 4 is a cross-sectional view of a second embodiment of a vacuum interface valve according to the present invention.

FIG. 4 shows a second embodiment of the present invention. In the first embodiment of FIG. 1, the weight 13 is employed as urging means for urging the valve member 5 downwardly. According to the second embodiment, a compressive coil spring is used as urging means. More specifically, a compressive coil spring 14 is provided between the upper wall of the housing 7 and the piston 8. Other structure of the second embodiment is the same as that of the first embodiment, and as such an explanation thereof is omitted.

Figure 5:
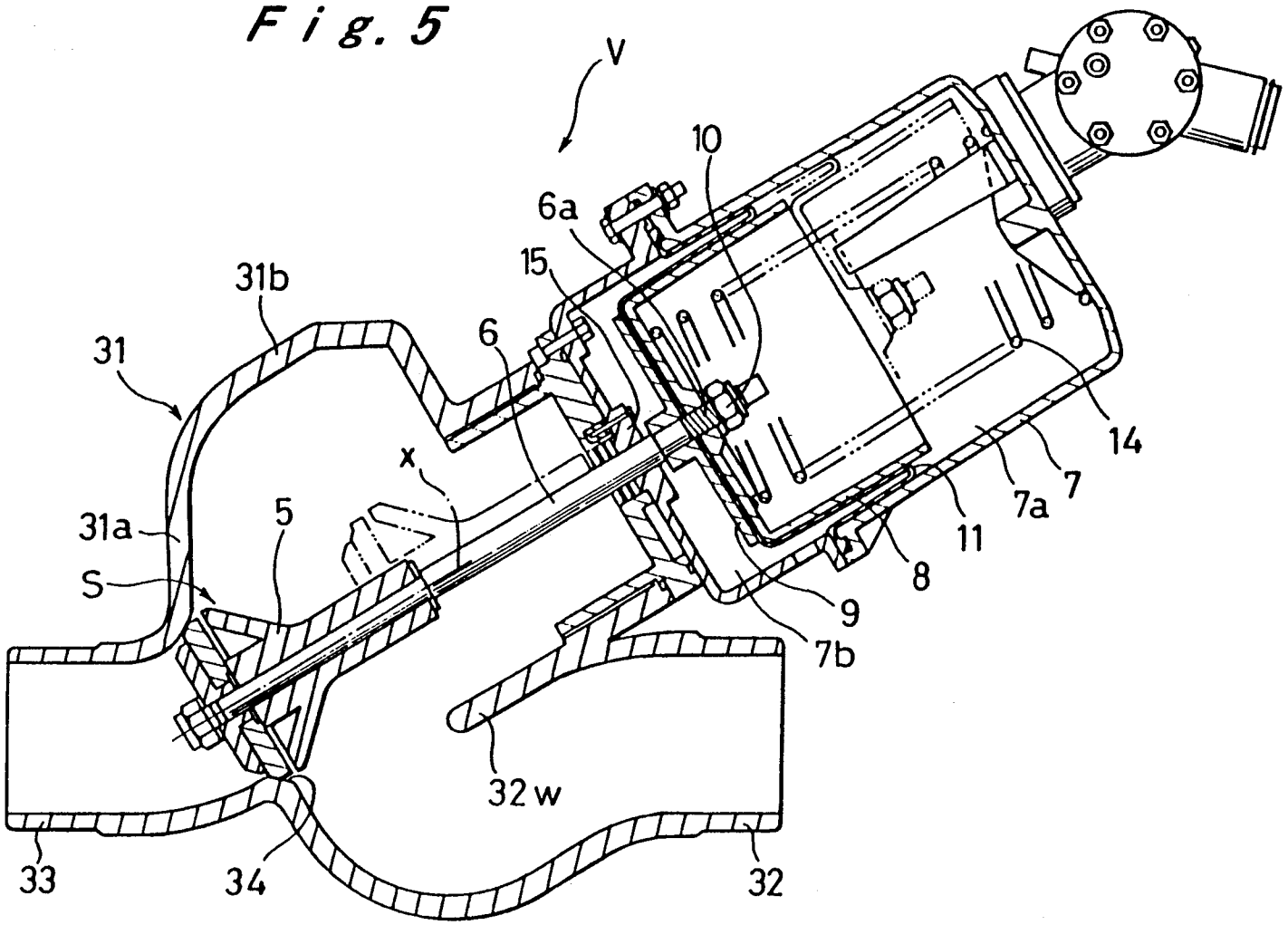
FIG. 5 is a cross-sectional view of a third embodiment of a vacuum interface valve according to a third embodiment of a third embodiment of the present invention.

FIG. 5 shows a third embodiment of the present invention. The casing in the third embodiment has a different shape than the casing 1 of the first embodiment. In this embodiment, the central axis of the casing 31 does not extend in a vertical direction, but is inclined with respect to the vertical direction. An inlet 32 and an outlet 33 of the casing 31 extend in a horizontal direction. The casing 31 is formed with a valve seat 34 at the bottom thereof. The casing 31 has a bottom wall 31*a* and a side wall 31*b* having the same shape as the bottom wall 1*a* and the side wall 1*b* of the casing 1 in FIG. 1 so that wide space S is defined in the vicinity of the valve seat 34. The inlet 32 has an inside wall portion 32*w* which extends parallel to the axis x of the valve member 5 inside the casing 31. The valve member 5 in the casing 31, the housing 7 and the piston 8 provided on the upper portion of the casing 31 are the same as those in FIG. 4. The operation of the vacuum interface valve of this embodiment is the same as that of the valve in FIG. 4.

As is apparent from the above description, according to the present invention, since the inner wall of the casing is bulged from the vicinity of the valve seat in a direction substantially perpendicular to the axis of the valve member, a wide space is defined in the vicinity of the valve seat so that foreign matters are not caught between the inner wall of the casing and the valve member. Further, the valve member can be prevented from being stuck at a partially opened position by the existence of the foreign matters, and so the vacuum sewerage system can be always operated in a normal condition.

Further, according to one aspect of the present invention, since the valve member is vertically moved and the lower surface of member engages the valve seat, the valve a weight can be utilized as the urging means of the valve member. By utilizing the weight, the force for lifting the valve becomes constant, thus facilitating the lifting the valve member up to the fully opened position. As a result, the valve member does not remain at a partially opened position, and the area of the flow passage is not restricted.

Furthermore, according to one aspect of the present invention, the inlet is disposed above the outlet which is disposed at the lowermost position of the casing, and the inlet has an inside wall portion which extends parallel to the axis x of the valve member inside the casing. Thus, liquid flowing into the inlet flows vertically downwardly parallel to the valve rod. Consequently, liquid does not impinge the valve member directly, and radial force is not applied to the valve member, so that wear of the bearing or looseness of the valve member can be prevented.

Although certain preferred embodiments of the present invention have been shown and described in detail, it should be understood that various changes and modification may be made therein without departing from the scope of the appended claims.

What is claimed is:

1. A vacuum interface valve for use in a vacuum sewerage system, said valve comprising:

a casing having an inlet, an outlet and a valve seat;

a valve member provided in said casing and being linearly movable along a longitudinal axis of the valve member between a position engageable with said valve seat and a position away from said valve seat;

means for urging said valve member into engagement with said valve seat; and means for lifting said valve member under the action of a vacuum to cause said valve member to disengage from said valve seat;

said casing having a bottom wall extending outwardly from said valve seat in a direction substantially perpendicular to the longitudinal axis of said valve member and a sidewall extending generally parallel to the longitudinal axis of the valve member from an end of said bottom wall remote from said valve seat so that said casing has a bulged configuration which inhibits foreign matters from being caught between said casing and said valve member.

2. The vacuum interface valve according to claim 1, wherein said inlet has an inside diameter of d, and a distance between said valve member and said side wall of said casing is 0.8 d or more when said valve member takes a fully opened position.

3. The vacuum interface valve according to claim 2, wherein a flow passage defined from said inlet to said outlet in said casing has a sectional area with a diameter of 0.8 d or more.

4. The vacuum interface valve according to claim 1, wherein said side wall is cylindrical, and said valve seat is located at a central portion of said bottom wall.

5. The vacuum interface valve according to claim 4, wherein said outlet is located at a central portion of said casing, and said inlet has an inside wall portion which extends parallel to the longitudinal axis of said valve member.

6. The vacuum interface valve according to claim 1, wherein said urging means comprises a weight.

7. The vacuum interface valve according to claim 1, wherein said urging means comprises a spring.

* * * * *